US008344231B2

(12) United States Patent
Hamilton

(10) Patent No.: US 8,344,231 B2
(45) Date of Patent: Jan. 1, 2013

(54) GUITAR PITCH STABILITY SYSTEM WITH SADDLE CLAMPS

(76) Inventor: John W. Hamilton, Rock Hill, NY (US)

( * ) Notice: Subject to any disclaimer, the term of this patent is extended or adjusted under 35 U.S.C. 154(b) by 146 days.

(21) Appl. No.: 12/927,358

(22) Filed: Nov. 12, 2010

(65) Prior Publication Data

US 2012/0118124 A1 May 17, 2012

(51) Int. Cl.
*G10D 3/04* (2006.01)

(52) U.S. Cl. ..... 84/298; 84/313; 84/297 R

(58) Field of Classification Search ..... 84/298, 84/313, 297 R

See application file for complete search history.

(56) References Cited

U.S. PATENT DOCUMENTS

| | | | | | |
|---|---|---|---|---|---|
| 2,741,146 | A | * | 4/1956 | Fender | 84/313 |
| 3,237,502 | A | * | 3/1966 | Moseley | 84/267 |
| 4,031,799 | A | * | 6/1977 | Fender | 84/307 |
| 4,171,661 | A | * | 10/1979 | Rose | 84/313 |
| 4,281,576 | A | * | 8/1981 | Fender | 84/298 |
| D269,440 | S | * | 6/1983 | Fender | D17/21 |
| 4,425,832 | A | * | 1/1984 | Peavey | 84/298 |
| 4,475,432 | A | * | 10/1984 | Stroh | 84/314 N |
| 4,541,320 | A | * | 9/1985 | Sciuto | 84/298 |
| 4,549,460 | A | * | 10/1985 | Gressett et al. | 84/298 |
| 4,608,905 | A | * | 9/1986 | Takabayashi | 84/313 |
| 4,608,906 | A | * | 9/1986 | Takabayashi | 84/313 |
| 4,688,461 | A | * | 8/1987 | Stroh | 84/298 |
| 4,690,028 | A | * | 9/1987 | Steinberger | 84/314 N |
| 4,724,737 | A | * | 2/1988 | Fender | 84/313 |
| 4,763,555 | A | * | 8/1988 | Minakuchi et al. | 84/313 |
| RE32,863 | E | * | 2/1989 | Edwards | 84/314 N |
| 4,823,669 | A | * | 4/1989 | Sarricola, Jr. | 84/313 |
| 4,860,628 | A | * | 8/1989 | Storey | 84/313 |
| 4,867,031 | A | * | 9/1989 | Fender | 84/313 |
| 4,892,025 | A | * | 1/1990 | Steinberger | 84/313 |
| 4,932,302 | A | * | 6/1990 | Saijo | 84/313 |
| 4,945,801 | A | * | 8/1990 | Stroh et al. | 84/314 N |
| 5,127,299 | A | * | 7/1992 | Stroh et al. | 84/314 N |
| 5,392,680 | A | * | 2/1995 | Stets | 84/313 |
| 5,448,935 | A | * | 9/1995 | Kosinar | 84/298 |
| 5,672,835 | A | * | 9/1997 | Doughty | 84/313 |
| 5,705,760 | A | * | 1/1998 | Rose | 84/298 |
| 5,783,763 | A | * | 7/1998 | Schaller et al. | 84/313 |
| D433,700 | S | * | 11/2000 | Gregory | D17/21 |
| 7,326,839 | B2 | * | 2/2008 | Kinoshita | 84/298 |
| 7,557,282 | B2 | * | 7/2009 | Holdway | 84/299 |
| 7,563,968 | B2 | * | 7/2009 | Medas | 84/298 |
| 7,705,225 | B2 | * | 4/2010 | Caldwell et al. | 84/298 |
| 7,772,470 | B1 | * | 8/2010 | Olsen | 84/313 |
| 7,868,235 | B2 | * | 1/2011 | Medas | 84/298 |
| 2012/0118124 | A1 | * | 5/2012 | Hamilton | 84/298 |

* cited by examiner

*Primary Examiner* — David Warren
*Assistant Examiner* — Robert W Horn

(57) ABSTRACT

This invention improves guitar pitch stability and requires no modifications to a guitar or any of its parts. It is a low profile design which pertains in particular to Fender Stratocasters or any electric guitars with a similar bridge plate and tone block design. This invention does basically two things. First, the guitar strings are rerouted giving a much softer string bend past the string saddles (similar to Gibson guitars) which significantly reduces string drag (friction) at the saddles. After "dive-bombing" downward or going upward in pitch via the tremolo arm (as with a Stratocaster), the guitar returns to its original pitch when the tremolo arm is released. Second, readjustable saddle clamps are used which hold and lock all six string saddles together in position and to the bridge plate after string height and intonation adjustments have been made.

5 Claims, 3 Drawing Sheets

GUITAR PITCH STABILITY SYSTEM WITH SADDLE CLAMPS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

This invention pertains in particular to Fender Stratocasters or any electric guitars with a similar bridge plate and tone block design. Regarding prior art, these guitars are traditionally strung by having the strings make nearly a 90 degree bend as they go over the string saddles and then terminate inside the guitar at the tone block. As such, there is significant string drag (friction) at the saddles which causes pitch stability problems when the tremolo arm is used . Other prior art solves this problem by rerouting the guitar strings (keeping them on the topside of the guitar) giving a much softer string bend past the string saddles which significantly reduces string drag (friction) at the saddles, but this prior art requires a modified bridge plate and string saddle assembly. This invention effectively solves the same problem also by rerouting the strings (topside of the guitar), the improvement here being: without any modifications to the guitar bridge plate or string saddles (i.e. these parts do not need to be replaced).

For the case where the guitar bridge has been setup in the traditional manner, one can only use the tremolo arm to go downward in pitch. While "dive-bombing" downward in pitch via the tremolo arm, the guitar strings relax in tension and tend to creep past the string saddles and down back into the interior of the guitar. When the tremolo arm is then released, the result is that the guitar goes and stays out of tune to a higher pitch (i.e. sharp). The same is true if the guitar has been setup in a "floating bridge" configuration. To get the guitar back to its original proper pitch, one has to do string bends upward in pitch and then release them to get the strings back to where they were with respect to the saddles before the tremolo arm was used. This problem exists even if the strings are lubricated at the string saddles according to manufacturer's recommendations.

The object of this invention is to effectively solve the pitch stability problems as previously described in prior art by significantly reducing string drag (friction) at the saddles. After use and then release of the tremolo arm, with this invention the guitar returns to its proper pitch. Prior art requires a modified bridge plate and string saddle assembly. This invention requires no modifications to a guitar or any of its parts and pertains in particular to Fender Stratocasters or any electric guitars with a similar bridge plate and tone block design. Note that the newer style rectangular-shaped string saddles are here required (not the vintage string saddles).

With this invention, the guitar strings are rerouted giving a much softer string bend past the string saddles (similar to Gibson guitars). This is accomplished by removing the intonation adjusting screw and spring from each of the six string saddles. The guitar is then restrung with each string first going through the corresponding hole in the bridge plate (on the top of the guitar). The string then goes through the hole in the string saddle (which previously held the intonation adjusting screw). The string then sits in the groove of the string saddle and the other end of the string is terminated as before at the tuning peg of the guitar neck. At this point, the string saddles are held in position by only the guitar strings.

Key to this invention are the two simple readjustable string saddle clamps (later described in detail) which hold and lock the string saddles together in position after string height and intonation adjustments have been made. With all six of the string saddles clamped together as a unit and the guitar tuned to pitch, they will not move (true even if a string breaks). Both the guitar strings and the saddle clamps hold the saddles in position. For this reason, if the guitar needs to be restrung, it should be done so one string at a time.

This invention has three other noteworthy features. First, it is a low-profile design and as such does not change the "feel" of the guitar. Second, the saddle clamps hold all six string saddles together as a unit and therefore level with respect to the bridge plate (in accordance with the string saddle manufacturer's recommendations). Third, it is possible to implement this invention without modifying a guitar or any of its parts (thus allowing a guitar to be easily put back to its original condition if desired).

DETAILED DESCRIPTION OF THE INVENTION

Items in this section are enumerated in conjunction with items depicted in FIG. 1 through FIG. 4.

Figure 1:
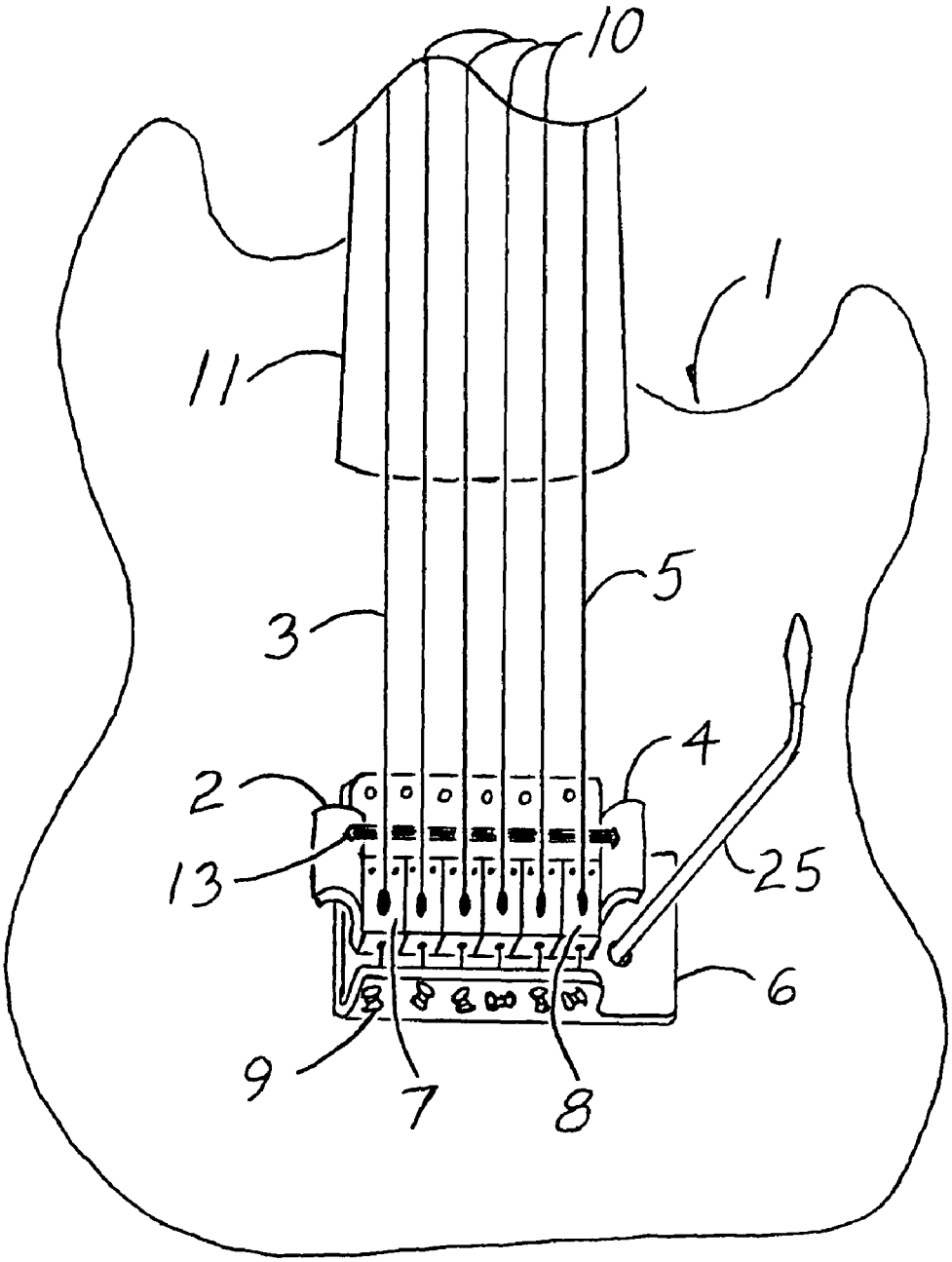
FIG. 1 is a simplified depiction of a Fender Stratocaster electric guitar showing the implementation of this invention.
Figure 2:
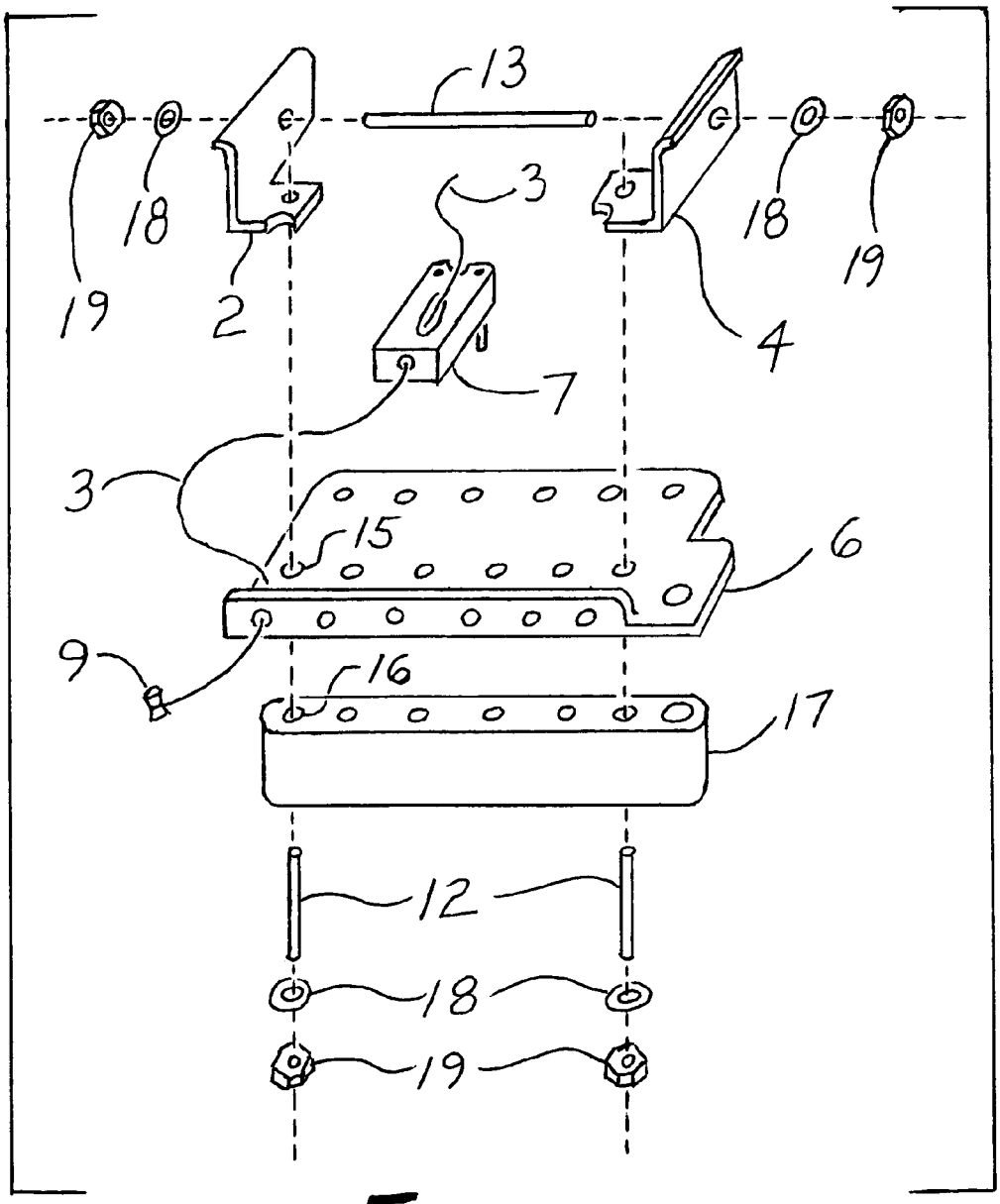
FIG. 2 is an exploded view of the guitar bridge plate and tone block showing both the assembly of the components of this invention and sample guitar string rerouting.
Figure 3:
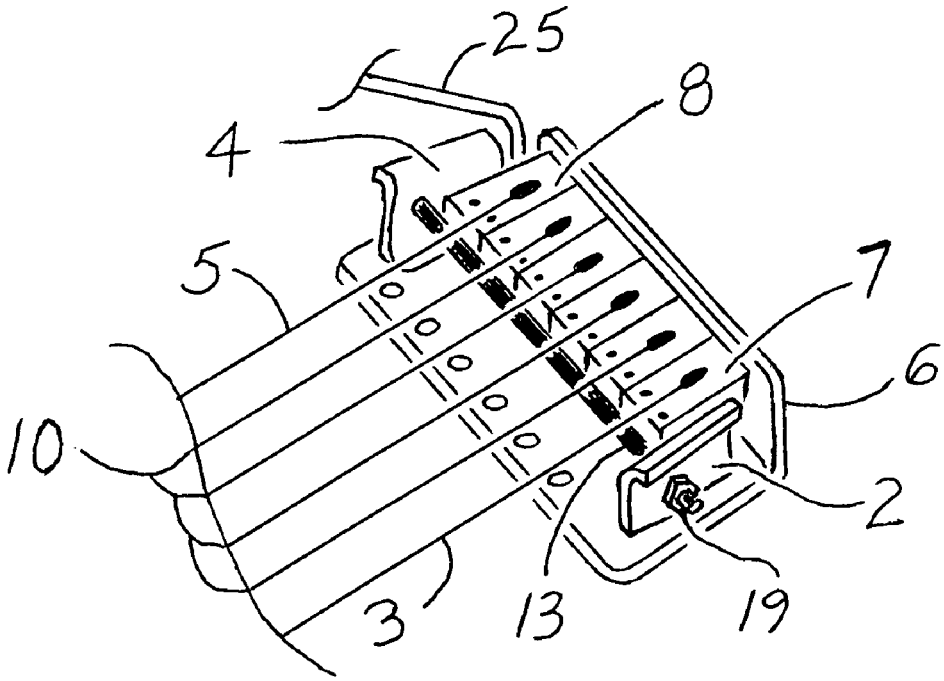
FIG. 3 is a close-up depiction of this invention clamping all six string saddles.

FIG. 1 is a simplified version of a Stratocaster guitar 1 (set to standard tuning) with tremolo arm 25. There is enough detail to show three of the invention components: the saddle clamp 2, the saddle clamp 4, and the clamp-connecting piece of threaded rod 13 (for clarity shown as a solid black horizontal rod which resides underneath the guitar strings). As previously described in paragraph [08] of the BRIEF SUMMARY OF THE INVENTION section, the guitar strings (lower E string 3, upper E string 5, and the middle four strings 10) are rerouted through the intonation holes in the top of the bridge plate 6 and the six string saddles (the lower E string saddle 7, the upper E string saddle 8, and the middle four string saddles (not enumerated due to excessive diagram clutter)). Note in particular the enumeration of the ball end 9 of the lower E string 3 (the upper E string 5 and the middle four guitar strings 10 have their ball ends terminated in a similar way at the bridge plate 6). The other end of the six guitar strings 3, 5, and 10 are terminated in the usual way out on the tuning pegs (not shown) of the guitar neck 11.

The following in particular refers to Stratocaster type guitars. With the intonation adjustment saddle screws removed, it is necessary to hold all of the string saddles in position with two saddle clamps 2 and 4. One clamp 2 contacts one side of the string saddle 7 used for the lower E string 3, the other clamp 4 contacts one side of the string saddle 8 used for the upper E string 5. What follows is derived from a hand-built working prototype of this invention.

The clamps 2 and 4 are each anchored to the bridge plate 6 by the use of a piece of 4-40 clamp-mounting threaded rod 12 (typical for both clamps). One end of this threaded rod is secured to each clamp via a threaded hole 14 in each clamp (typical). For the clamp 2 used on the lower E string saddle 7, the threaded rod 12 goes down through the vacant hole 15 in the bridge plate 6 and the vacant hole 16 in the tone block 17 (these holes 15 and 16 were previously occupied by the lower E string 3). Underneath the guitar 1, the other end of the threaded rod 12 is secured to the tone block 17 via a washer 18 (typical elsewhere) and hex nut 19 (typical elsewhere). In a similar way, the saddle clamp 4 for the upper E string saddle 8 is mounted to the bridge plate 6 (in the vacant holes of the bridge plate 6 and tone block 17 previously occupied by the upper E string 5). With the two saddle clamps 2 and 4 installed via their threaded rods 12 and their hex nuts 19 snugly tightened, these clamps can pivot slightly. With this invention, the ball end of the guitar strings no longer terminate in the tone block 17, but rather out on the bridge plate 6 on top of the guitar 1.

The clamp-connecting piece of 4-40 threaded rod 13 should now loosely be installed through the remaining hole 21 (typical) in each of the saddle clamps 2 and 4. A washer 18 and hex nut 19 are used to secure the threaded rod 13 at either end. Note that the low profile design is such that this rod sits underneath the guitar strings.

The guitar 1 should now be loosely strung (ball-ended or bullet-ended strings can be used), with each string 3, 5, and 10 first going through their respective hole in the bridge plate 6, then the hole in their respective string saddle (e.g. 7 and 8), each string then sitting in its groove of the string saddle, and finally terminating at the tuning peg of the guitar neck 11. With all six string saddles installed, the clamp-connecting piece of threaded rod 13 should be tightened snug at this point to position the string saddles flush with each other. The string saddle height and intonation adjustments can now be made with the guitar 1 tuned to proper pitch. To complete the setup: tighten the two clamp-mounting threaded rods 12 (one for each of the clamps 2 and 4) at the tone block 17 (from underneath the guitar), and then tighten the clamp-connecting piece of threaded rod 13. The tightened threaded rod 13 provides the clamping force for the two saddle clamps 2 and 4 against the cluster of all six string saddles.

Figure 4:
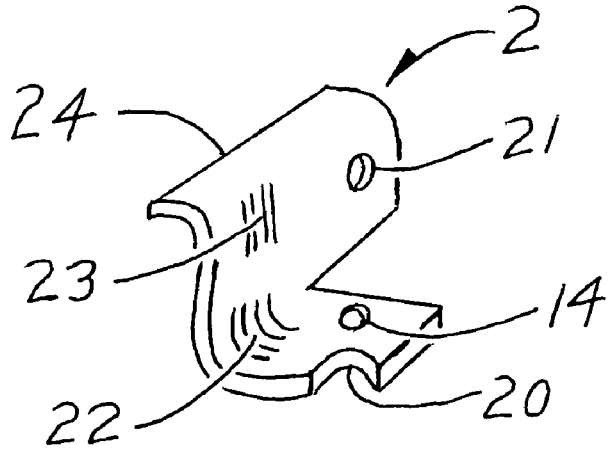
FIG. 4 is a close-up view of the saddle clamp which contacts the lower E string saddle.

For what follows in the rest of this section, refer to FIG. 4 regarding specific details of the saddle clamp 2 which contacts the lower E string saddle 7. Note that the two saddle clamps (2 and 4) are effectively mirror images of one another (so this discussion is applicable to both clamps). The surface of the clamps 2 and 4 which contact the string saddles 7 and 8 should be milled, molded, or shaped to provide a true 90 degree corner 22 (underneath the saddle) and a true flat mating surface of contact 23 between the clamp and the saddle. This is necessary to prevent the string saddles from lifting upward when they are clamped. Note that when the clamps are fabricated, if the correct spacing is used with respect to the clamp mounting hole 14 and the mating surface of contact 23, then the saddle clamps 2 and 4 will engage the side of the two outermost string saddles 7 and 8 properly when the clamps are tightened.

The saddle clamp upper lip 24 should be there to provide additional strength where the clamp-connecting piece of threaded rod 13 acts as the clamping mechanism. The lip 24 should be outward and away from the string saddles to allow for access to the string height adjustment set screws of the saddles. Alternately, thicker, stronger material could be used for the clamps to eliminate this lip.

The prototype saddle clamps 2 and 4 were built from 1/16 inch thick stainless steel. They could be constructed of even thicker material, without interfering with the position of the string saddles 7 and 8 from underneath (with the guitar strings now going through the saddles, they tend to "float" above the bridge plate 6 at the end furthest away from the saddle string height adjusting set screws).

The bottom mounting surface of the saddle clamps 2 and 4 have a rounded corner cut-out 20. This is necessary so that the bottom mounting surface of each clamp is flush with the bridge plate 6. Otherwise, there would be interference between the bottom surface of the clamps and the large counter-sunk flat head tone block mounting screws in the bridge plate. Alternately, instead of a rounded corner cut-out 20, the corner could be square, with the underside of this corner being milled to remove some metal to provide clearance for the large counter-sunk flat head tone block mounting screws.

For the anchor points of the saddle clamps 2 and 4, instead of 4-40 clamp-mounting threaded rod 12, a 4-40 button-head (low profile) screw could be used (eliminating a washer 18 and a hex nut 19 for each).

Note that for the clamp-connecting piece of threaded rod 13, a 4-40 machine screw could be used (eliminating a hex nut 19).

Changes can be made to the invention with respect to the physical embodiments set forth in the specification and drawings, without departing from the scope and spirit of the invention as set forth in the claims section.

The invention claimed is:

1. An improvement to a guitar tremolo bridge and saddle unit that comprises a bridge plate with upturned flange, a tone block, individual string saddles per strings, and strings that go over the individual saddles at a sharp angle through the bridge plate and secure in the tone block and where the string saddles include individual intonation adjustment screws between the string saddles and the upturned flange, where the improvement provides a means to have a guitar restrung entirely on the topside of said guitar with one end of the strings terminating on or at the bridge plate, which significantly reduces an angle of deflection of the strings as they go over the string saddles, thereby reducing string drag or friction at the saddles and improving pitch stability, the modification to the bridge plate and saddles comprises a re-use of the original parts in a different way to omit threading the strings into the tone block and to omit the intonation adjustment screws between the upturned flange of the bridge plate and the respective saddles, system comprising a pair of readjustable saddle clamp jaw units, for holding all the saddles together as a unit with the mating surface of the first jaw mechanism contacting the first exposed side of the string saddles at the saddle used for the first string at the first side and anchored to the bridge plate via a fastener through the first jaw and into the string hole vacated by the first string, and the mating surface of the second jaw mechanism contacting the second exposed side of the string saddles at the saddle used for the last string at the second side and anchored to the bridge plate via a fastener through the second jaw and into the string hole vacated by the last string;

each jaw comprising an upturned plate and pivotable about its fastener and comprising a hole in the upturned plate and an adjustable fastener extending between the upturned plates of the first jaw and the second jaw, where tightening the adjustable fastener pivots the upturned plates together to secure the saddles via the jaws to the bridge plate;

where the strings can now thread across the saddles and be secured into the upturned flange of the bridge plate in the holes vacated by the intonation adjustment screws.

2. The improvement to the tremolo bridge and saddle unit of claim 1 where the jaw units are secured to the bridge plate by a fastener selected from the group comprising a threaded rod and a pair of nuts and a machine screw.

3. The improvement to the tremolo bridge and saddle unit of claim 2 where the selected fastener further comprises the use of a washer at each attachment location.

4. The improvement to the tremolo bridge and saddle unit of claim 1 where the jaw units are secured together by a fastener selected from the group comprising a threaded rod and a pair of nuts and a bolt and a nut combination.

5. The improvement to the tremolo bridge and saddle unit of claim 4 where the selected fastener further comprises the use of a washer at each attachment location.

* * * * *